United States Patent [19]

King

[11] 4,230,541

[45] Oct. 28, 1980

[54] PRETREATMENT OF CATHODES IN ELECTROHYDRODIMERIZATION OF ACRYLONITRILE

[75] Inventor: Christopher J. H. King, Pensacola, Fla.

[73] Assignee: Monsanto Company, St. Louis, Mo.

[21] Appl. No.: 77,869

[22] Filed: Sep. 21, 1979

[51] Int. Cl.[3] ..... C25B 3/10

[52] U.S. Cl. ..... 204/73 A

[58] Field of Search ..... 204/73 A, 59 R

[56] References Cited

U.S. PATENT DOCUMENTS

| | | | |
|---|---|---|---|
| 3,245,889 | 4/1966 | Baizer | 204/73 A |
| 3,689,382 | 9/1972 | Fox et al. | 204/73 A |
| 4,046,651 | 9/1977 | Burnett et al. | 204/73 R |
| 4,155,818 | 2/1979 | Campbell et al. | 204/73 A |

FOREIGN PATENT DOCUMENTS

| | | | |
|---|---|---|---|
| 1089707 | 11/1967 | United Kingdom | 204/73 A |
| 1447772 | 9/1976 | United Kingdom | 204/73 A |

*Primary Examiner*—F. C. Edmundson

*Attorney, Agent, or Firm*—Thomas Y. Awalt, Jr.

[57] ABSTRACT

An improvement in the process of electrohydrodimerizing acrylonitrile to adiponitrile wherein cadmium-plated cathodes, which are employed in the process as a part of an electrolytic cell, are pretreated by contacting the cathode surface with an oxidizing agent comprising peroxide.

7 Claims, 1 Drawing Figure

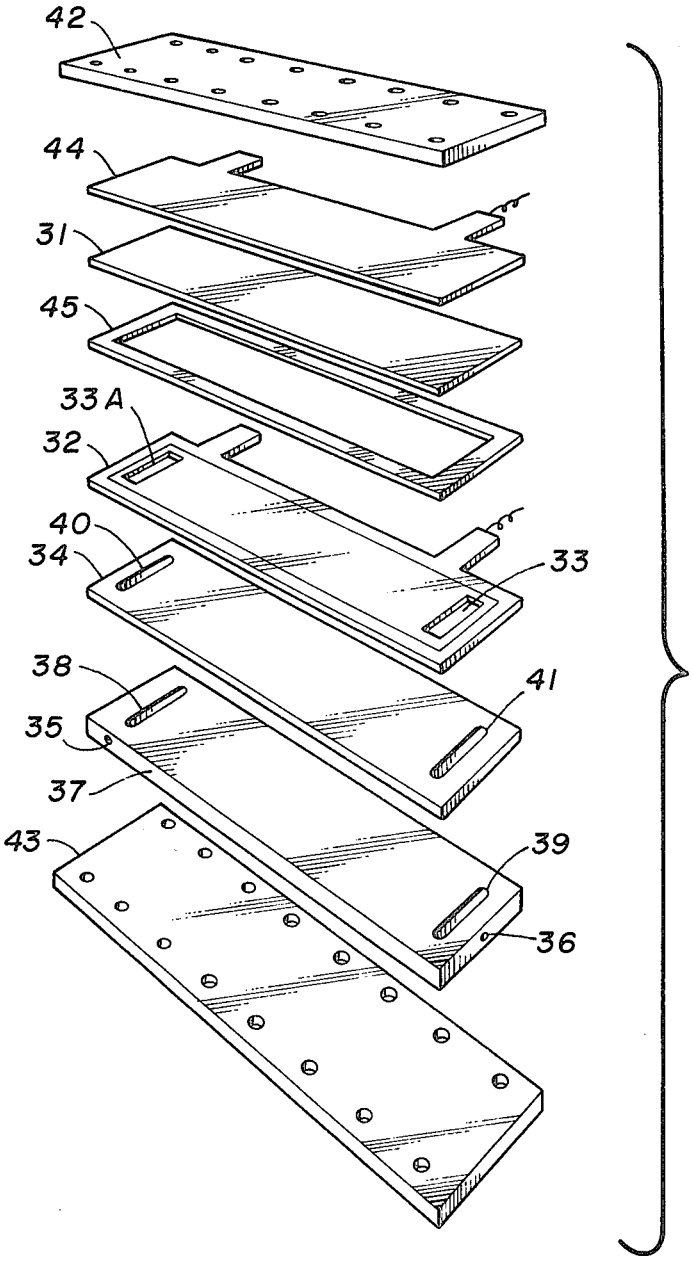
42
44
31
45
33A
32
40
34
33
38
41
35
37
43
39
36

PRETREATMENT OF CATHODES IN ELECTROHYDRODIMERIZATION OF ACRYLONITRILE

BACKGROUND OF THE INVENTION

A. Field of the Invention

The invention relates to the production of adiponitrile from acrylonitrile by electrochemical synthesis, and particularly to an improvement in such a process wherein the cathodes are pretreated with an oxidizing agent.

B. Background of the Invention

The reduction of acrylonitrile to adiponitrile by electrohydrodimerization is taught in British Pat. No. 1,089,707 (to Tomilov). In such a reaction, it is often preferred to use cathodic surface metals selected for high hydrogen over-voltage, and although metals such as lead, thallium, zinc, mercury and cadmium are preferred, because of the expense of the material and the lack of strength of these materials, it is common practice to electroplate the desired metal on a more suitable metal such as steel which is strong, readily available and inexpensive. A suitable cathode, for example, for the electrohydrodimerization of acrylonitrile to adiponitrile is cadmium-plated steel.

SUMMARY OF THE INVENTION

This invention is an improvement in the process for the production of adiponitrile from acrylonitrile by electrolytic dimerization in an electrolytic cell having a dimerization electrolyte and electrodes (anodes and cathodes), and where at least a substantial portion of the cathodes are cadmium or cadmium-plated. The improvement comprises pretreating the cathode by contacting the surface of the cathode with an oxidizing agent comprising acidic hydrogen peroxide.

THE DRAWING

The FIGURE is an exploded assembly of an experimental electrode cell of a type described in the examples which may be pretreated according to this invention.

DETAILED DESCRIPTION OF THE INVENTION

A description of a typical process for the production of adiponitrile from acrylonitrile, suitable for employment in conjunction with the improvement described herein, is contained in U.S. Pat. No. 3,960,697 (hereby incorporated by reference).

The electrolytic cell employed in the process described preferably comprises a cadmium-plated carbon steel cathode. The substrate of the metal-plated cathode (and the anode surface) preferably consists essentially of carbon steel as opposed as to iron, alloy steel or stainless steel. Carbon steel, as defined herein (and by the American Iron and Steel Institute [AISI]) is as follows: "carbon steel is classed as such when no minimum content is specified or guaranteed for aluminum, chromium, colombiumn, molybdenum, nickle, titanium, tungsten, vanadium, or zirconium; when the minimum for copper does not exceed 0.40 percent; or when the maximum content specified or guaranteed for any of the following elements does not exceed the percentages noted: maganese 1.65; silicon 0.60, copper 0.60."

I have discovered that pretreating the cadmium-plated surface by contacting the surface with an oxidizing agent comprising acidic hydrogen peroxide results in a significantly better selectivity to adiponitrile in the electrohydrodimerization process.

Contacting may be by dipping, spraying, misting, wiping or brushing. The time of exposure is not critical. For example cadmium may be immersed in peroxide for about 15 seconds to about 5 minutes for effective treatment according to this invention. The hydrogen peroxide is applied from an acidic solution of about 10–50% (preferably 30%) by wt-$H_2O_2$. Any acid may be employed to acidify which does not interfere with the action of the peroxide. Acetic acid is preferred. Preferably the solution also contains 25-75% alkyl alcohol which may assist in detaching oxidized particles. The hydrogen peroxide may be formed in situ from any of the solid peroxides or introduced directly to the cathode.

After contacting the cathode with peroxide it may be desirable to rinse or wash the cathode before electrohydrodimerization, but rinsing or washing is not required. Water, alkyl alcohol or mixtures thereof may be used for washing.

The process improvement described above should be distinguished from cathode fouling removal which may also be required periodically. Pretreatment of the cathodes, as described herein contemplates (but does not require) that the cathode to be pretreated is a freshly cleaned or electroplated cathode. The physical effect of such pretreatment is not known; but it is believed to be an oxidation of the rough perifery of the cathode.

Referring in detail to the drawing, the essential portions of the simplified cell are cathode (31) and anode (32), which are separated by plastic spacer (45). A circulation chamber is defined by cathode (31), anode (32) and the inside perimeter of plastic spacer (45). A circulation chamber is defined by cathode (31), anode (32) and the inside perimeter of plastic spacer (45). The electrolyte solution is fed through aperture (36) and slot (39) of polyethylene feed block (37) through slot (41) of neoprene gasket (34) and slot (33) of anode (32) to the aforementioned circulation chamber, and from the circulation chamber through slot (33A) of anode (32), slot (40) of neoprene bottom gasket (34), slot (38) of polyethylene feed block (37), and out through aperture (35) of polyethylene feed block (37), and out through aperture (35) of polyethylene feed block (37). The entire assembly, including plastic upper and lower plates (42) and (43) and conductor plate (44) is assembled in fixed parallel-planar relationship. Plastic spacer (45) assures uniform spacing of the element from cathode (31). Spacer (45), in this particular embodiment is 0.178 cm thick.

EXAMPLES

Electrolysis units used for the examples below, included a pump for circulating the aqueous sodium phosphate electrolyte which was mixed with an organic phase containing acrylonitrile and the reaction products. The electrolyte stream passed through a heat exchanger, between two electrodes spaced 0.178 cm apart, out of the cell through an off-gas disengaging vessel to a decanter where part of the organic layer was separated and removed as product, the remainder being recirculated along with acrylonitrile fed to the circulation pump, again to be pumped through the electrolysis cell. Typically the aqueous solution contained approximately 1.6% acrylonitrile, 1.2% adiponitrile, 0.2% acrylonitrile electrohydrodimerization by-products, $5.8\times10^3$ grams mole per liter of bis-dibutylethyl-1-6-hexane and 200–300 ppm of tetrasodium ethylenediaminetetraacetate. Triethanol amine was added at the rate of 50 mg/Faraday of electricity. Entrained in the solution was approximately 1% by weight of an organic phase containing about 54% adiponitrile, 29% acrylonitrile, 9% acrylonitrile dimerization by-products and 8% water. The unit contained 2 electrolysis cells ("A" and "B"), with lengths of 24 inches, the cells running parallel one to another.

EXAMPLES 1 and 2

(Comparative Examples)

These examples were typical of the best of electrohydrodimerization processes without the pretreatment of this invention. The selectivity to ADN (adiponitrile) averaged 88.99%±0.12 (with 95% confidence limits).

EXAMPLE 3

In this run, the cadmium cathodes were pretreated by dipping in a solution consisting of 3 ml acetic acid, 100 ml methanol and 60 ml hydrogen peroxide (about 30%). The surface was then washed with methanol, also by dipping, and a mirror-like finish was achieved. Selectivity to ADN averaged 89.57%±0.16 (with 95% confidence limits).

EXAMPLE 4

(Comparative Example)

In this example, cadmium cathodes having a substandard (rough) cathode surface was used, without pretreatment according to this invention. A deterioration of selectivity to adiponitrile and some fouling of the electrode resulted. Selectivity to ADN averaged 87.32%±0.79 (with 95% confidence limits).

EXAMPLES 5 and 6

Substandard cathodes similar to those used in Example 4, but pretreated as in Example 2 were employed. The pretreatment resulted in improved selectivities averaging 89.57%±0.38 (with 95% confidence limits).

I claim:

1. In an electrochemical process for hydrodimerization of acrglonitrile which comprises electrolyzing in a reaction cell an aqueous electrolyte solution, the aqueous electrolyte solution being in contact with a cadmium cathode surface, the improvement comprising contacting the cathode surface with an oxidizing agent comprising acidic hydrogen peroxide before electrolyzing the aqueous electrolyte solution.

2. The process of claim 1 wherein the oxidizing agent comprises 10–50% by weight hydrogen peroxide.

3. The process of claim 2 wherein the oxidizing agent is a component of a solution also comprising acetic acid and methanol.

4. The process of claim 3 wherein the oxidizing agent comprises 30% hydrogen peroxide.

5. The process of claim 1 wherein after the contacting and before electrolyzing the cathode surface is washed with water.

6. The process of claim 1 wherein after the contacting and before electrolyzing the cathode surface is washed with a non-aqueous rinse.

7. The process of claim 6 wherein the rinse comprises methanol.

* * * * *